US005373098A

United States Patent [19]

Kitayama et al.

[11] Patent Number: 5,373,098

[45] Date of Patent: Dec. 13, 1994

[54] DEVICE FOR GENERATING TONE SIGNALS USING MODULATION

[75] Inventors: Toru Kitayama; Iwao Higashi, both of Hamamatsu, Japan

[73] Assignee: Yamaha Corporation, Japan

[21] Appl. No.: 939,669

[22] Filed: Sep. 3, 1992

[30] Foreign Application Priority Data

Sep. 4, 1991 [JP] Japan ..... 3-250192

[51] Int. Cl.[5] ..... G10H 1/12

[52] U.S. Cl. ..... 84/659; 84/661; 84/DIG. 9

[58] Field of Search ..... 84/624, 627, 659–661, 84/663, 694–696, 699, 700, 702, 703, 735, 736, 738, DIG. 9, DIG. 10

[56] References Cited

U.S. PATENT DOCUMENTS 5,157,215 10/1992 Nakae et al. ..... 84/624
5,157,216 10/1992 Chafe ..... 84/695
5,164,530 11/1992 Iwase ..... 84/624

FOREIGN PATENT DOCUMENTS 58-48109 10/1983 Japan .
59-19354 5/1984 Japan .

*Primary Examiner*—Stanley J. Witkowski
*Attorney, Agent, or Firm*—Graham & James

[57] ABSTRACT

A desired sound signal that is input from outside is amplitude-modulated or frequency-modulated with a signal of a predetermined characteristic which is generated from a signal generating source. A frequency characteristic controlling circuit controls the frequency characteristic of the modulated sound signal in accordance with a characteristic of a tone to be generated, and it outputs the controlled signal as a tone signal.

17 Claims, 7 Drawing Sheets

8 TONE SIGNAL GENERATING CIRCUIT

8 TONE SIGNAL GENERATING CIRCUIT

8a TONE SIGNAL GENERATING CIRCUIT

20 PITCH FORMING CIRCUIT

19 PARAMETER GENERATING CIRCUIT

15a SOUND PROCESSING SECTION

20a PITCH FORMING CIRCUIT

DEVICE FOR GENERATING TONE SIGNALS USING MODULATION

BACKGROUND OF THE INVENTION

This invention relates to a tone signal generating device, and more particularly to a tone signal generating device which is capable of controlling, by means of a simple structure, tone color of a tone to be generated, in an extensive and diversified manner with increased flexibility.

In Japanese Patent Publication No. Sho 59-19354, for example, a tone signal generating device is disclosed which generates a tone signal utilizing a noise signal produced from a signal generating source. More specifically, a tone signal generating device, a noise signal having, at an uniform level, frequency components of virtually all band areas. The noise signal is passed through a filter that is composed of delay loop circuitry of a comb-like frequency characteristic having a plurality of resonance peaks, so that a signal of a specific frequency band corresponding to a depressed key on a keyboard etc. is selectively extracted. The extracted signal is then generated as a tone signal which has a pitch corresponding to the depressed key.

However, because the prior art tone signal generating device merely generates a noise signal regular or fixed frequency characteristics by means of an impulse generator or white noise generator or the like and then passes the regular noise signal through the comb filter, it can only control tone color of a tone to be generated, with a limited flexibility to a limited extent (it only relies on the comb filter characteristics). To solve such a problem, it may be effective to alter the construction of the filter circuit and also variably establish the filter coefficients. But, this approach is not satisfactory in that it requires a large scale circuitry and and also requires complex control for establishing filter coefficients.

Therefore, it is an object of the present invention to provided a tone signal generating device which is capable of controlling, by means of a simple structure, tone color of a tone to be generated in an extensive and diversified manner with increased flexibility.

SUMMARY OF THE INVENTION

A tone signal generating device according to the present invention comprises a signal generating source for generating a signal of a predetermined characteristic, a sound signal inputting section for inputting a desired sound signal, a modulating section for modulating the sound signal input from the inputting section with the signal of the predetermined characteristic generated from the signal generating source, and a frequency characteristic controlling section for controlling, in accordance with a desired characteristic of a tone to be generated, a frequency characteristic of the sound signal modulated by the modulating section, so that the sound signal controlled by the controlling section is generated as a tone signal.

The signal generating source generates a signal that contains an uniform level of individual frequency components within a certain band area. The sound signal inputting section inputs a desired sound signal having a certain frequency characteristic. The modulating section modulates, with the signal generated from the signal generating source, the sound signal input from the inputting section. The frequency characteristic controlling section controls, in accordance with a desired characteristic of a tone to be generated, a frequency characteristic of the sound signal modulated by the modulating section. The sound signal whose frequency characteristic has been controlled by the characteristic controlling section is then output as a tone signal.

As stated, the present invention is not directed to generating a tone signal merely on the bas is of the processing by filters etc. of fixed or regular noise signal. But, according to the invention, any desired or irregular sound signal is input for modulation with a signal of a predetermined characteristic, and a tone signal is generated on the basis of such modulation. Because of this arrangement, the invention can control tone color of a tone to be generated, in an extensive diversified manner with increased flexibility, without relying on complex and large-scaled circuitry.

The desired sound signal input from the sound signal inputting section may be of any audible sounds such as human voice, human breath, scratchy or percussive sound obtained by scratching or striking suitable objects with each other, or sound produced by a musical instrument.

Further, a modulation operation employed by the modulating section may be an amplitude-modulation in which the sound signal is used as a carrier wave signal and the signal of a predetermined characteristic is used as a modulating signal.

The modulating section may comprise a section for detecting an intensity of the sound signal input from the sound signal inputting section, a filter section for variably controlling a frequency characteristic of the signal generated from the signal generating source with a control characteristic corresponding to the detected intensity, and a section for modulating the sound signal input from the sound signal inputting section with the signal whose frequency characteristic has been controlled by the filter section.

Now, the preferred embodiments of the present invention will be described in detail below with reference to the drawings.

DETAILED DESCRIPTION OF THE PREFERRED EMBODIMENTS

Figure 1:
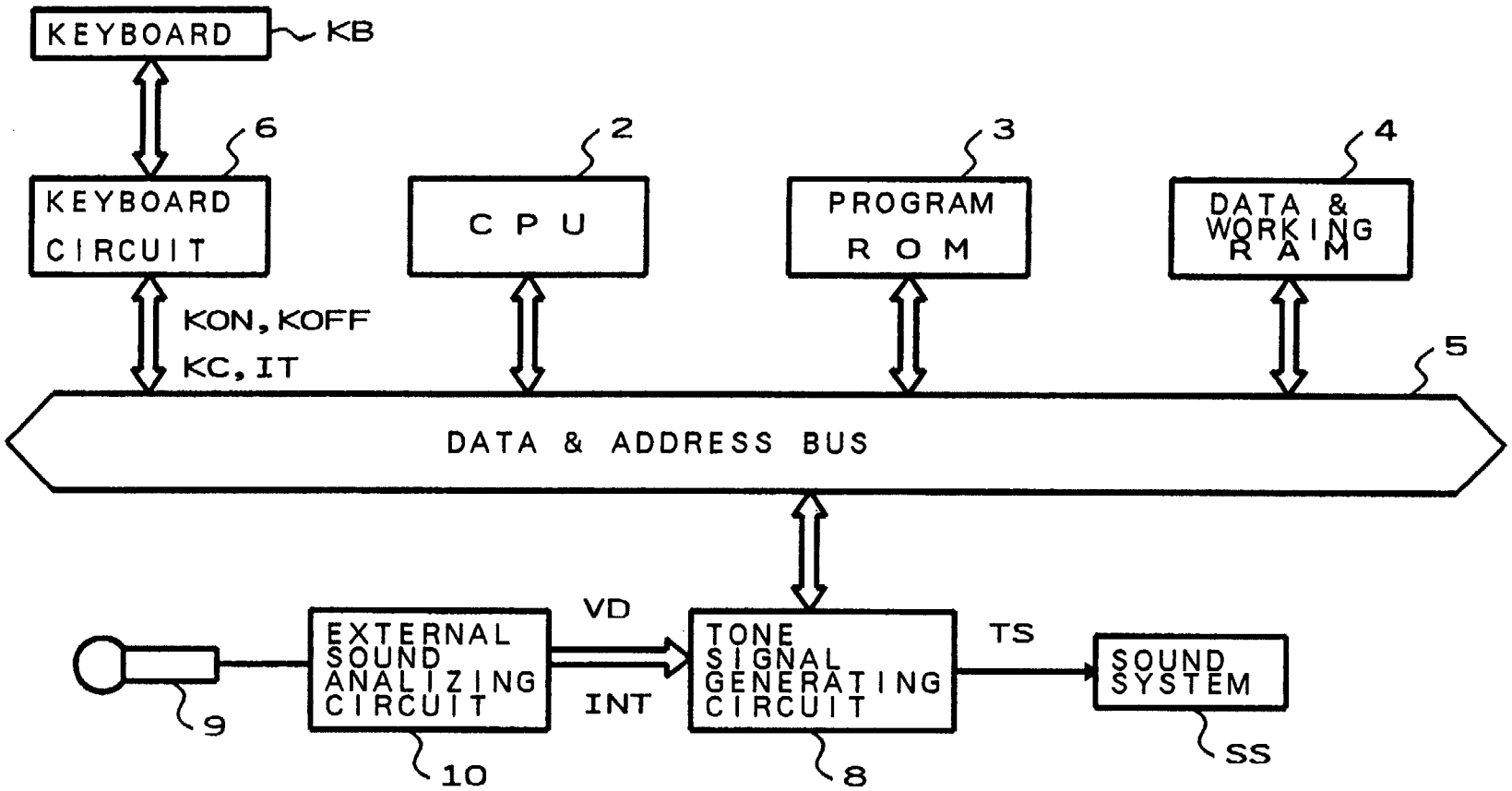
FIG. 1 is a block diagram showing the overall hardware structure of an example of an electronic musical instrument that incorporates a tone signal generating device according to the present invention.

FIG. 1 is block diagram showing an overall hardware structure of an example of an electronic musical instrument which employs a tone signal generating device according to the present invention.

The electronic musical instrument is designed to perform various processes under the controls of a microcomputer which comprises a CPU 2, program ROM 3, and data and working RAM 4. Via a data and address bus 5, a keyboard circuit 6, tone signal generating circuit 8 etc. are connected to the microcomputer.

The keyboard circuit 6 comprises a plurality of key switches provided in corresponding relations to a plurality of keys of the keyboard KB which are operated by the player for designating the pitch of a tone to be generated. The keyboard circuit 6 detects a key depression or key release, on the basis of which it outputs a key-on signal KON or key-off signal KOFF, a key code KC identifying a key related to the key depression or key release and initial touch data IT indicative of the key depression intensity or key depression velocity.

A tone signal generating circuit 8 is capable of generating a tone signal on the basis of a certain desired or irregular sound signal associated with the player's voice or other kinds of sounds which is input from a microphone 9 via an external sound analyzing circuit 10, as described below. With the capability of generating a tone signal utilizing such a certain desired irregular sound signal input from a microphone 9, the tone signal generating circuit 8 can control the timbre or tone color of a tone to be generated in an extensive manner and thus permits generation of a tone having a tone color that is more like that of a natural musical instrument. The tone signal thus generated in a digital form by the tone signal generating circuit 8 is converted to an analog form and then is audibly reproduced through a sound system denoted at SS.

Figure 2:
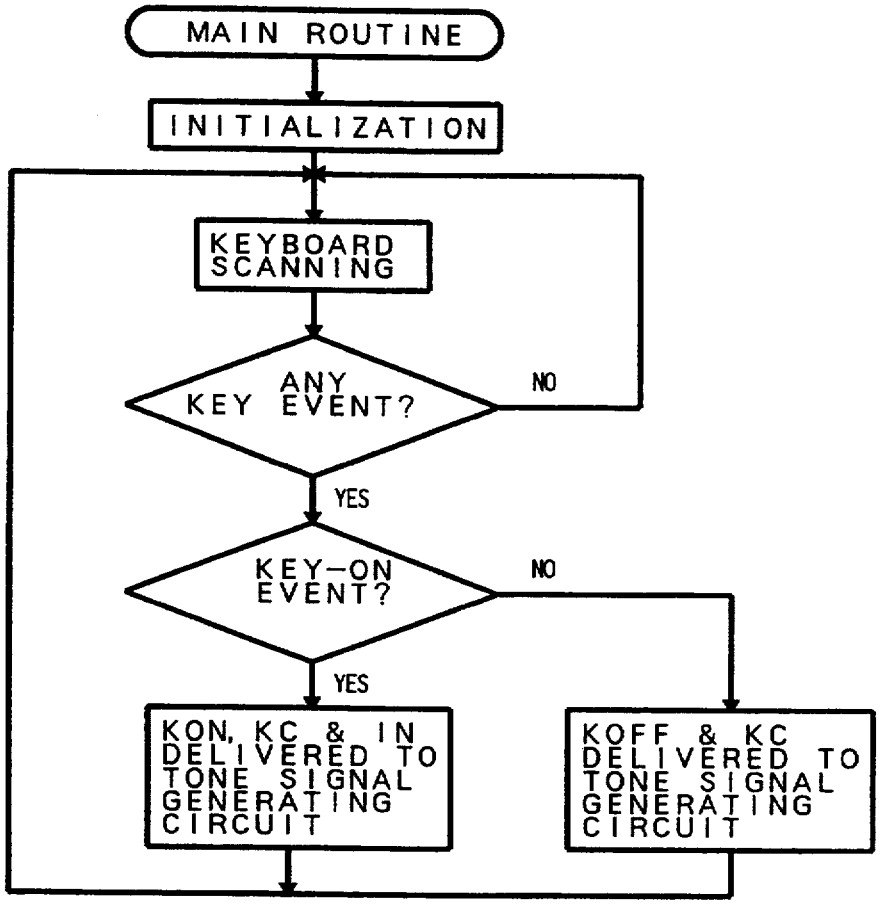
FIG. 2 is flowchart showing an example of the main routine that is carried out by a microcomputer shown in FIG. 1.
Figure 3:
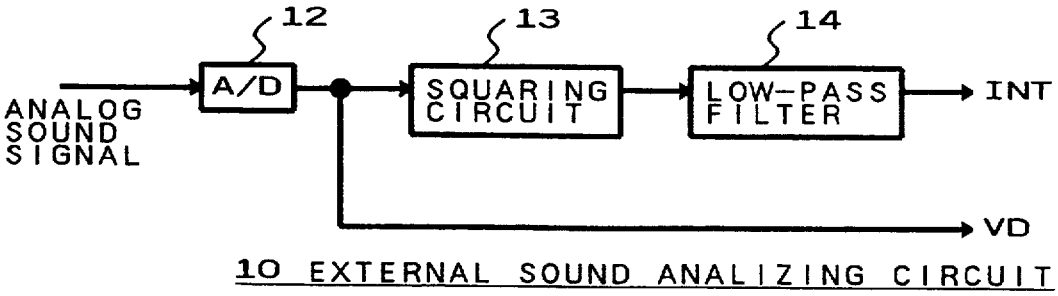
FIG. 3 is a block diagram showing an example of the structure of an external sound analyzing circuit shown in FIG. 1.
Figure 4A:
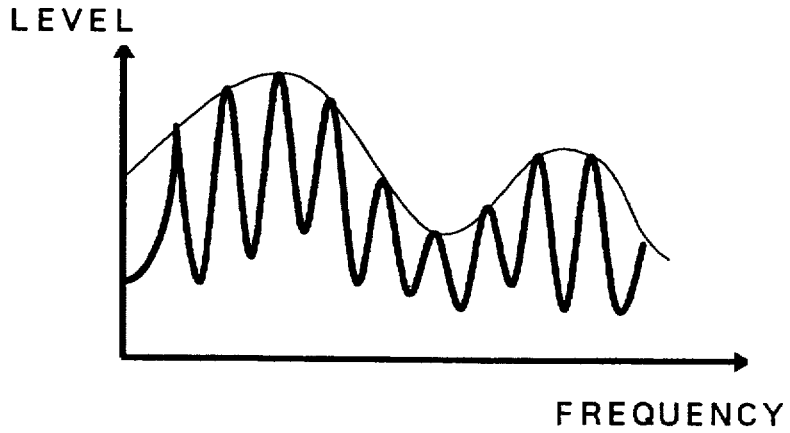
FIGS. 4*a*—4*c* are diagrams explanatory of the operation of the tone signal generating device according to the present invention, showing the frequency spectrum characteristics of an input sound signal and of the sound signal that has been processed by the tone signal generating device.

FIG. 2 shows an example of a main routine that is carried out by the microcomputer shown in FIG. 1. In the main routine, the individual key switches of the keyboard circuit 6 are scanned for detection of their on/off states, after the completion of predetermined initialization procedures. When there has been detected any key-on event as the result of the scan, a key-on signal KON, key code KC and initial touch data IT output from the keyboard circuit 6 are delivered to the tone signal generating circuit 8. When, on the other hand, there has been detected any key-off event, a key-off signal KOFF and key code KC are delivered to the tone signal generating circuit FIG. 3 is a block diagram showing an example structure of the external sound analyzing circuit 10. An analog-to-digital converter 12 serves to convert an analog sound signal input from the microphone 9 to a digital sound signal. It should be appreciated here that a sound signal to be input through the microphone 9 is not restricted to that of human voice but may be any other suitable audible sound signals such as that of human breath, scratchy sounds produced by scratching suitable objects with each other or tones produced by a musical instrument. FIG. 4*a* illustrates an example of spectrum characteristics of such a sound signal input through the microphone 9. The digital sound signal is passed to a squaring circuit 13 and is also provided as an input sound signal VD to the tone signal generating circuit 8. The squaring circuit 13 squares the tone volume level value of the digital sound signal so as to obtain a value corresponding to the absolute tone volume level value of the digital sound signal. A low-pass filter 14 serves to cut off predetermined high frequency components from the output signal of the squaring circuit 13 so as to detect the tone volume envelope level of the input sound signal VD. The detected tone volume envelope level is then passed to the tone signal generating circuit 8 as sound intensity data INT indicative of the tone volume intensity of the sound signal. Of course, in stead of squaring the tone volume level value in the squaring circuit 13, the absolute tone volume level value may be obtained in a direct manner and then used as sound intensity data INT.

Figure 5:
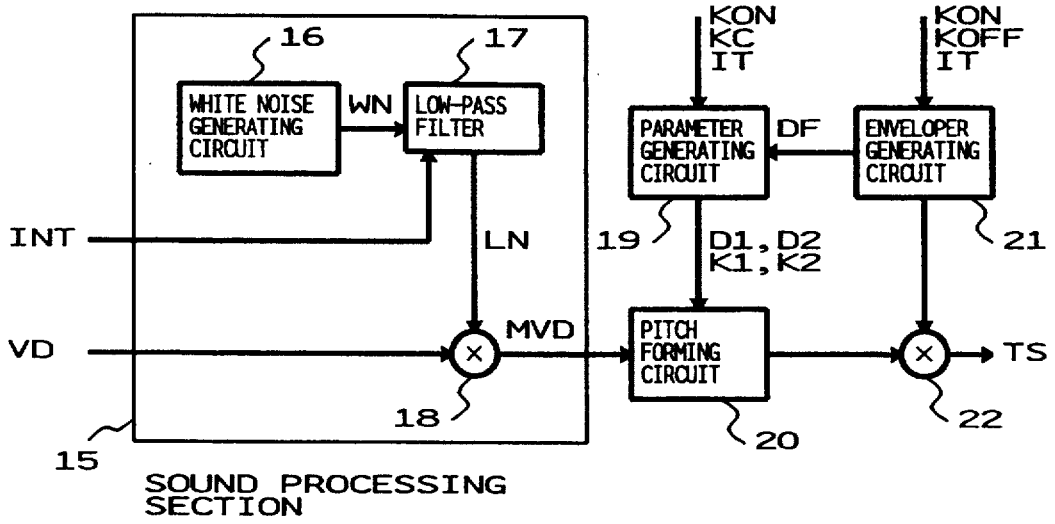
FIG. 5 is a block diagram showing an example of the structure of a tone signal generating circuit shown in FIG. 1.

FIG. 5 is a diagram showing in detail an example structure of the tone signal generating circuit 8. In a sound processing section 15, a white noise generating circuit 16 serves to generates a white noise WN that contains, at a uniform level, all frequency components within a given wide frequency band. A low-pass filter 17 has its cut-off frequency controlled in accordance with the sound intensity data INT provided from the external sound analyzing circuit 10. For example, the low-pass filter 17 processes the white noise WN with a high cutoff frequency when the sound intensity data INT is great in value, and it process the white noise WN with a low cut-off frequency when the sound intensity data INT is small in value.

Figure 4B:
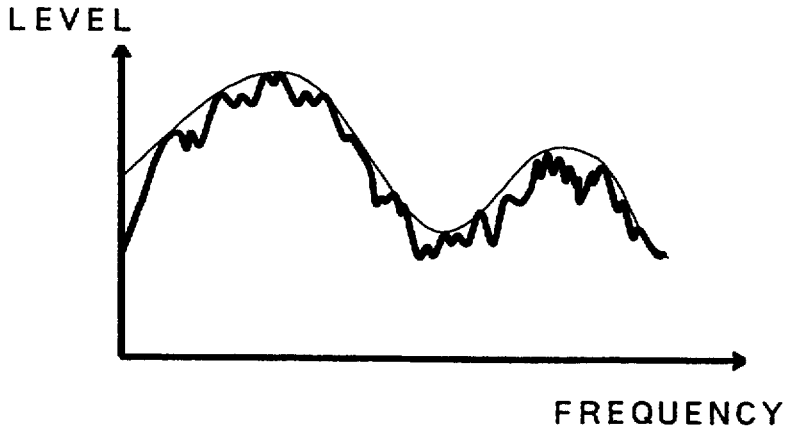

A multiplier 18 multiplies the input sound signal VD provided from the external sound analyzing circuit 10, by a low-pass noise signal LN output from the low-pass filter 17. In this manner, the multiplier 18 performs an amplitude modulation (AM) operation in which the input sound signal VD is used as a carrier wave signal and the low-pass noise signal LN as a modulating wave signal. In FIG. 4*b*, there shown an example frequency spectrum characteristic of a sound signal MVD as modulated by the multiplier 18. As may be appreciated from the figure, the modulated sound signal MVD has a noise-like frequency spectrum in which a sideband has occurred due to the frequency components of the output noise signal of the low-pass filter 17, while maintaining a spectrum envelope of the input sound signal VD as shown in FIG. 4*a*. For example, when the value of the sound intensity data INT is great in value, the cut-off frequency of the low-pass filter 17 is controlled to become high as mentioned earlier, so that the amplitude modulation operation on the input sound signal VD is performed with a high frequency. Thus, the resultant sound signal MVD will have a frequency spectrum similar to that of the white noise WN. This enables such a control by which the modulated sound signal MVD is caused to have a higher noise percentage when the input sound has a larger volume and is caused to have a lower noise percentage when the input sound has a smaller volume.

The sound signal MVD is passed to a pitch forming circuit 20. The pitch forming circuit 20 receives from a parameter generating circuit 19 various parameters that correspond to a depressed key on the keyboard KB, and forms, on the basis of the sound signal MVD, a tone signal having a pitch corresponding to the depressed key.

Figure 6:
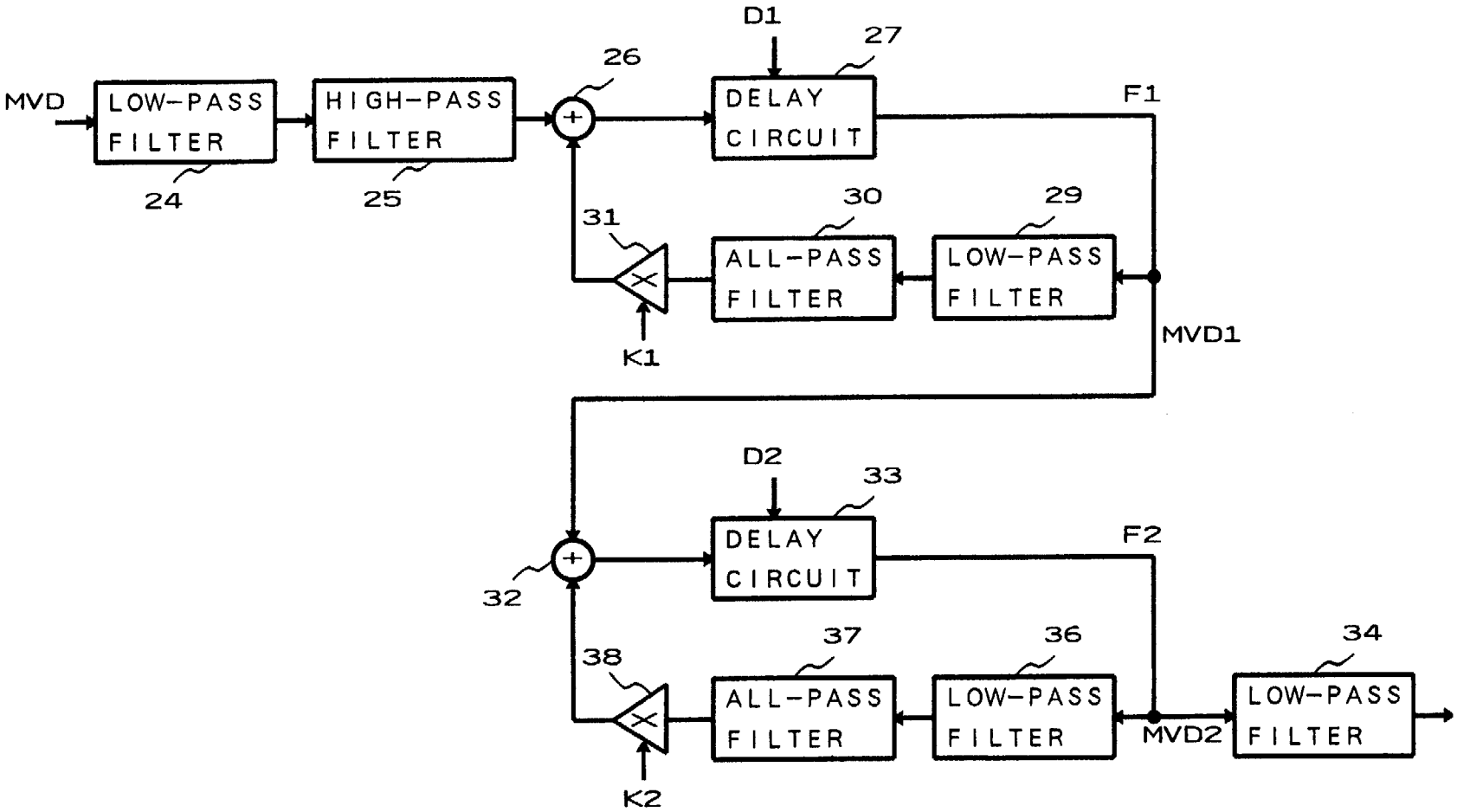
FIG. 6 is a block diagram showing an example of the structure of a pitch forming circuit employed in the tone signal generating circuit of FIG. 5.

FIG. 6 shows an example of a detailed structure of the pitch forming circuit 20. A low-pass filter 24 serves to cut off, from the sound signal MVD provided from the sound processing section 15, high frequency components which are not necessary for making up a tone. A high-pass filter 25, on the other hand, serves to cut off, from the sound signal MVD, low frequency components close to direct current components which are not necessary for making up a tone. However, these filters 24, 25 are not necessarily essential to the invention and therefore may be omitted.

The sound signal MVD passed through the filters 24, 25 is provided to two stages of comb filter circuits F1, F2 that are connected in series with each other. Each of the comb filter circuits F1, F2 is constructed so as to achieve a comb-like frequency spectrum having a plurality of resonance peaks. That is to say, an adder circuit 26 of the front-stage comb filter circuit F1 adds the sound signal MVD with a signal obtained by processing the previous output signal of the circuit F1. The sound signal MVD output from the adder circuit 26 is given to a delay circuit 27, which delays the sound signal MVD in accordance with a delay time setting parameter D1. The delay time setting parameter D1 defines the length of a delay time D1t to be achieved in the delay circuit 27. Due to the comb filter characteristic, the fundamental frequency i.e. pitch of a sound signal MVD1 to be output from the comb filter circuit F1 is determined in correspondence with the delay time D1t in the delay circuit 27. The fundamental frequency i.e. pitch thus determined is inversely proportional to the length of the delay time D1t.

The sound signal MVD1 output from the delay circuit 27 is given to the rear-stage comb filter circuit F2. Simultaneously, the signal MVD1 is fed back to the adder 26 after having been processed in a low-pass filter 29, all-pass filter 30 and multiplier 31 as described later. The low-pass filter 29, which is set at a fixed cut-off frequency, is provided for cutting off, from the output sound signal of the delay circuit 27, high frequency components that are not necessary for making up a tone. The low-pass filter 29 is not necessarily essential to the invention and therefore may be omitted. The all-pass filter 30 that allows all the frequency components to pass therethrough is provided for controlling inharmoneousness of a tone by its phase characteristic, in view of the generally-known fact that filters have such a phase characteristic that produces a phase difference corresponding to the frequency components processed therein.

A multiplier 31 multiplies the output signal of the all-pass filter 30 by a feedback coefficient K1 supplied from the parameter generating circuit 19. The feedback coefficient K1 determines the degree or ratio of feedback in the front-stage comb filter circuit F1; that is, in this embodiment, a larger value of the feedback coefficient K1 permits a larger feedback degree. For example, if the feedback coefficient K1 is "0" there will be no feedback in the comb filter circuit F1, in which case no resonance frequency control will be performed in the comb filter circuit F1, and therefore no particular pitch will be imparted to the output sound signal MVD1. Further, as the value of the feedback coefficient K1 becomes greater, the peak of the resonance frequency is caused to be steeper in the comb filter circuit F1. As the result, particular frequency components are extracted, so that the sound signal MVD1 comes to have a particular pitch corresponding to the extracted frequency components. The output of the multiplier 31 is applied to the adder 26 for being added to new sample data of the input sound signal MVD and is then passed to the delay circuit 27.

The rear-stage comb filter circuit F2 has a similar structure to the front-stage comb filter circuit F1. The rear-stage comb filter circuit F2 processes the sound signal MVD1 output from the front-stage comb filter circuit F1 in a substantially similar manner to the filter circuit F1. More specifically, an adder 32 adds the sound signal MVD1 from the front-stage comb filter F1, with a signal obtained by processing the previous output signal of the comb filter circuit F2. The output signal of the adder 32 is given to a delay circuit 33, by which the signal is delayed in accordance with a delay time setting parameter D2 supplied from the parameter generating circuit 19. The delay time setting parameter D2 defines the length of a delay time D2t to be achieved in the delay circuit 33. The fundamental frequency pitch of a sound signal MVD2 output from the comb filter circuit F2 is inversely proportional to the length of the delay time D2t.

The output signal of the delay circuit 33 is given to a low-pass filter 34. Simultaneously, the output signal of the delay circuit 33 is fed back to the adder 32 after having been processed by a low-pass filter 36, all-pass filter 37 and multiplier 38 as described below. Namely, the low-pass filter 36 is provided for cutting off, from the output signal of the delay circuit 33, high frequency components that are not necessary for making up a tone. The all-pass filter 37 that allows all the frequency components to pass therethrough is provided for controlling inharmoniousness of a tone by its phase characteristic.

Figure 4C:
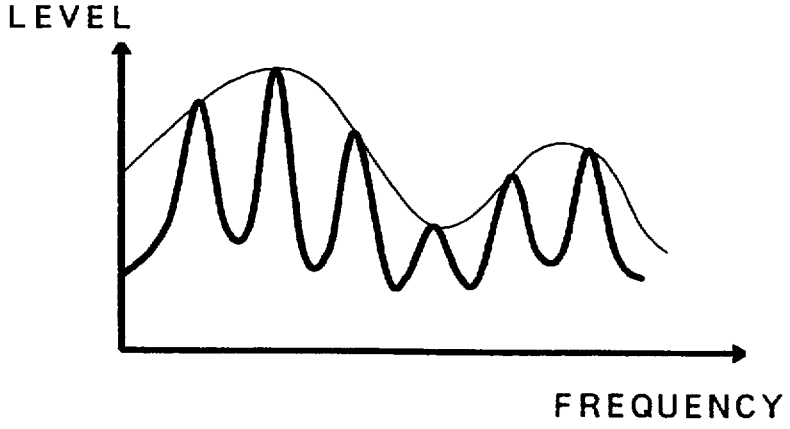

A multiplier 38 multiplies the output signal of the all-pass filter 37 by a feedback coefficient K2 supplied from the parameter generating circuit 19. The feedback coefficient K1 determines the degree or ratio of feedback in the rear-stage comb filter circuit F2; that is, in this embodiment, a larger value of the feedback coefficient K2 permits a larger feedback degree. The output of the multiplier 38 is applied to the adder 32 for being added to new sample data of the input sound signal MVD and is then passed to the delay circuit 33. FIG. 4c shows an example frequency spectrum characteristic of the sound signal MVD2 which has been imparted a particular pitch through the above-mentioned processes in the comb filter circuits F1, F2. It will be readily appreciated from this figure that peaks of resonant frequencies have steepened.

The primary reason why the dual stages of the comb filter circuits F1, F2 are provided in this pitch forming circuit 20 is that the dual structure can achieve steepened resonant frequency peaks step by step or in a sharing manner, using relatively gentle feedback coefficients in the comb filter circuits F1, F2. The loop will result in an oscillation if peaks of plural resonant frequencies are rapidly steepened by only one stage of comb filter circuit using a large feedback coefficient, for example, as large as "1". The other reason is that the dual structure can achieve various controls. For example, at the rise (attack) time etc. of a tone, it can create a pitch discrepancy ("detune") of the output sound signal MVD2 by transitionally differentiating the delay time setting times D1, D2, and at the stabilized time of the tone, it can equalize the two delay time setting parameters D1, D2.

Figure 7:
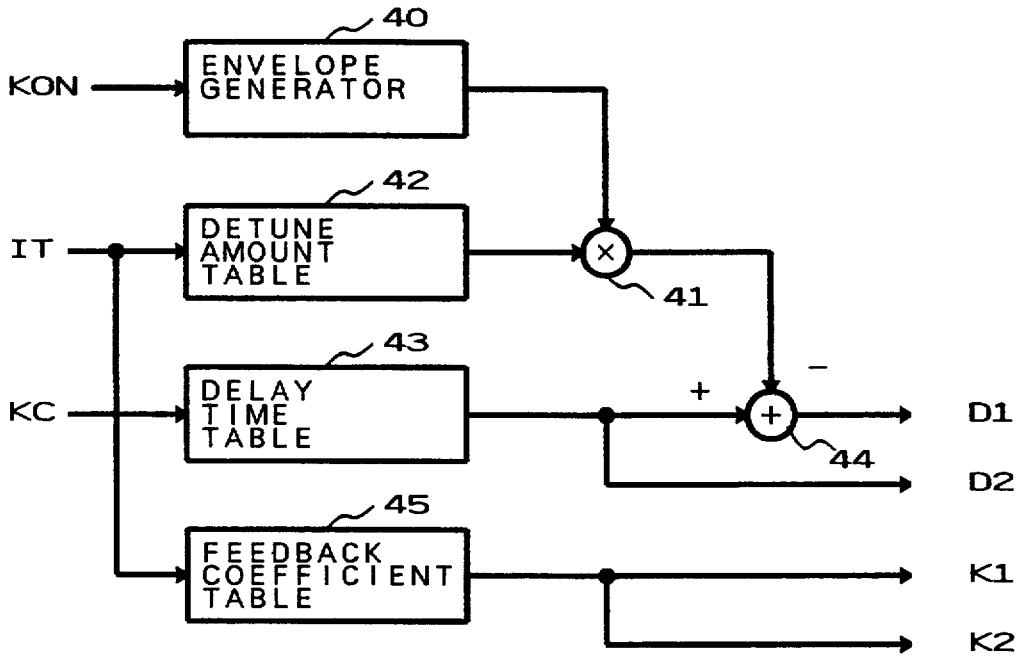
FIG. 7 is a block diagram showing an example of the structure of a parameter generating circuit employed in a tone signal generating circuit of FIG. 5.

Referring now to FIG. 7, there is shown in detail an example structure of the parameter generating circuit 19, which enables a detune at the rise time of a tone as mentioned above. Namely, an envelope generator 40 generates, in response to a key-on signal KON given thereto under the control of the microcomputer, envelope waveform data that has an attack level corresponding to the value of initial touch data IT. The envelope waveform data is output to a multiplier 41. In a detune amount table 42, detune amount data are stored in corresponding relations to various values of individual initial touch data. Detune amount data that is read out from the detune amount table 42 in correspondence with initial touch data is multiplied by the above-mentioned envelope waveform data in the multiplier 41. Further, in delay time table 43, delay time data corresponding to individual key codes are stored in such a manner that they are allowed to establish delay times D1t, D2t corresponding to the pitch represented by a key code KC. Delay time data that is read out from the delay time table 43 in correspondence with a key code KC is given as delay time setting parameter D2 to the delay circuit 33 of the rear-stage comb filter circuit F2, and at the same time it is also given to a subtracter 44. The subtracter 44 subtracts an output value of the multiplier 41 from the value of the delay time data read out from the delay time table 43. The subtraction result of the subtracter 44 is given as delay time setting parameter D1 to the delay circuit 27 of the front-stage comb filter circuit F1.

With such arrangements, different delay times D1t, D2t are established in the delay circuits 27, 33, so that a detune at the attack time of a tone which corresponds to the initial touch intensity can be achieved. In an opposite manner to the foregoing, the delay time data read out from the delay time table 43 may be given as the delay time setting parameter D1 to the delay circuit 27 of the front-stage comb filter circuit F1, and the subtraction result of the subtracter 44 may be given as the delay time setting parameter D2 to the rear-stage comb filter circuit F2. Further, in the case where the above-mentioned detune is not effected, the envelope generator 40, multiplier 41, detune amount table 42 and subtracter 44 may be omitted, and delay time setting parameters D1, D2 for always setting the same delay time D1t, D2t may be supplied from the delay time table 43 to the respective delay circuits 27, 33 of the filter circuits F1, F2.

Moreover, in a feedback coefficient table 45, feedback coefficient data corresponding to individual initial touch data are stored so that a feedback degree corresponding to an initial touch intensity can be established in the respective multipliers 31, 38 of the comb filter circuits F1, F2. Feedback coefficient data read out from the feedback coefficient table 45 is directly given as feedback coefficients K1, K2 to the multipliers 31, 38. For example, in the case where feedback coefficients K1, K2 that establish low feedback degrees when the value of initial touch data IT is great in value are given to the delay circuits 27, 33, the output sound signal MVD2 of the pitch forming circuit 20 will have a great noise content. On the other hand, in the case where feedback coefficients K1, K2 that establish high feedback degrees when the value of initial touch data IT is small in value are given to the delay circuits 27, 33, the output sound signal MVD2 of the pitch forming circuit 20 will have a small noise content.

The sound signal MVD2 that has been processed through the pitch forming circuit in the foregoing manner is applied to the low-pass filter 34 which cuts off high frequency components not necessary for making up a tone, and it is then delivered to a multiplier 22.

An envelope generating circuit 21 generates, in response to a key-on signal KON and a key-off signal KOFF, envelope waveform data ED indicative of an amplitude envelope that has an attack level corresponding to initial touch data IT. The multiplier 22 multiplies the sound signal MVD2 by the envelope waveform data ED, in order to impart the signal MVD2 an envelope as a tone. Thus, as the output of the multiplier 22, a tone signal TS is obtained whose amplitude varies with time accordance with the envelope waveform data ED. When the impartment of the decay port ion of the envelope has been completed (i.e., when the envelope waveform data has reached the value of "0", a decay end signal DF is given from the envelope generating circuit 21 to the parameter generating circuit 19. In response to the decay end signal DF, the feedback coefficients K1, K2 that are supplied from the parameter generating circuit 19 to the pitch forming circuit 20 are switched to the value of "0".

Now, description will be made on the operation of the tone signal generating device according to the embodiment.

A sound signal input through the microphone 9 is received by the external sound processing 10, which generates, on the basis of the received sound signal, input sound signal VD and sound intensity data INT both in digital form. The input sound signal VD and sound intensity data INT thus generated are then delivered to the sound processing section 15. In the sound processing section 15, the low-pass filter 17 performs a low-pass process on a white noise signal produced by the white noise generator 16, with cut-off frequency corresponding to the sound intensity data INT and then outputs a low-pass processed, namely, low-pass noise signal LN to the multiplier 18. The multiplier 18 performs a multiplication between the input sound signal VD and the low-pass noise signal LN in order to effect an amplitude modulation on the input sound signal VD with the low-pass noise signal LN, and then the multiplier 18 outputs a modulated sound signal MVD to the pitch forming section 20. The modulated sound signal MVD thus output from the sound processing section 15 has a noise-like frequency spectrum which is accompanied by sideband components of the low-pass noise signal LN as shown in FIG. 4*b*.

Upon receipt of the modulated sound signal MVD, the pitch forming section 20 performs, by means of the dual-stage comb filter circuits F1, F2, a process for forming a tone signal having a pitch that corresponding to a depressed key on the keyboard KB. Namely, respective delay times D1t, D2t for the delay circuits 27, 33 are control led in accordance with delay time setting parameters D1, D2 supplied from the parameter generating circuit 19, and the fundamental frequency of an output sound signal MVD2 is controlled in accordance with the delay times D1t, D2t. Also, respective feedback degrees to be achieved by the multipliers 31, 38 are controlled in accordance with feedback coefficients K1, K2 supplied from the parameter generating circuit 19, and steepness of resonance frequency peaks in an output signal from the pitch forming circuit 20 is controlled in correspondence with the feedback degrees.

The sound signal MVD2 processed in the pitch forming circuit 20 in the above-mentioned manner is then multiplied in the multiplier 22 by envelope waveform data ED generated from the envelope generating circuit 21 so that it is imparted an amplitude envelope. After the impartment of the amplitude envelope, the sound signal MVD2 is output as a tone signal TS to the sound system SS for audible reproduction.

Figure 8:
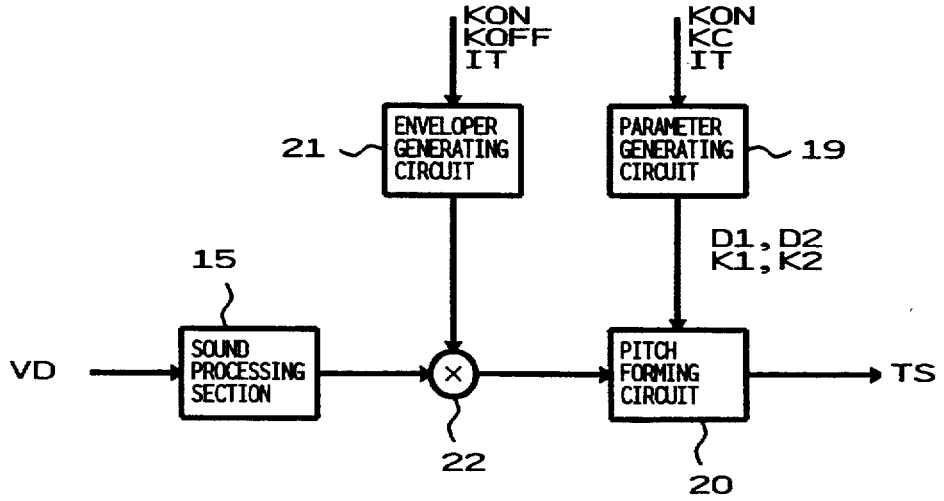
FIG. 8 is a block diagram showing a modification of the tone signal generating device.

A modification of the tone signal generating circuit 8 is shown in FIG. 8. In this modified tone signal generating circuit 8*a*, the multiplier 22 for imparting an envelope is provided in front of the pitch forming circuit 20, in an opposite manner to the tone signal generating circuit 8 of FIG. 5, so that the sound signal MVD output from the sound processing section 15 is imparted an envelope before it is processed in the pitch forming circuit 20. With this arrangement, the sound signal MVD is caused to decay by the impartment of the envelope, and thus, unlike the arrangement of FIG. 5, it is not necessary to perform, at the decay end, the process for outputting a decay end signal DF from the envelope generating circuit 21 to the parameter generating circuit 19 and switching the feedback coefficients K1, K2 supplied from the parameter generating circuit 19 to the pitch forming circuit 20 to the value of "0".

Figure 9:
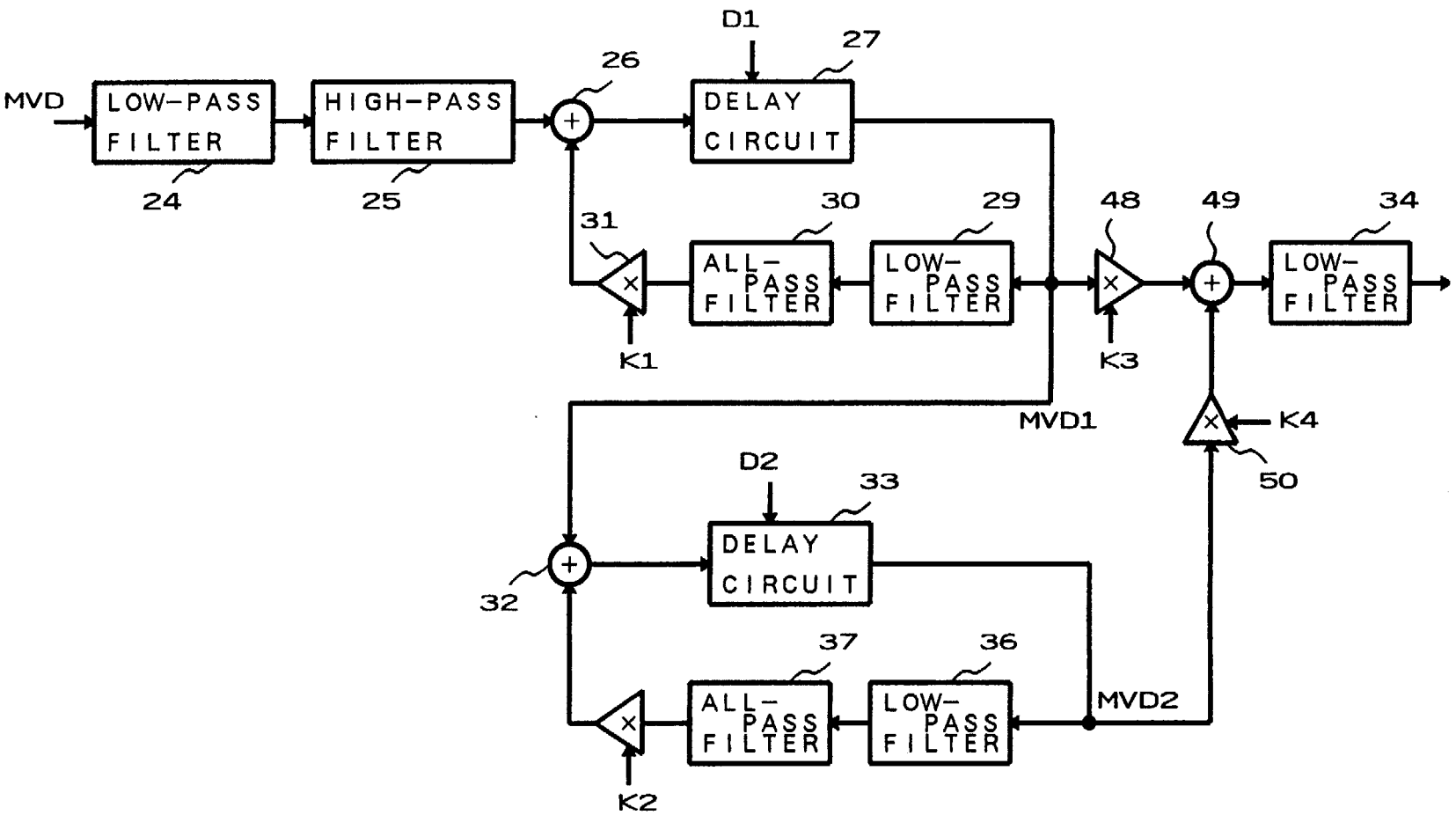
FIG. 9 is a block diagram showing a modification of the pitch forming circuit.

Further, FIG. 9 shows a modification of the pitch forming circuit 20 of FIG. 6. In this modified pitch forming circuit 20*a*, the dual-stage comb filter circuits F1, F2 are connected in parallel, as opposed to the pitch forming circuit 20 of FIG. 6 in which the dual-stage comb filter circuits F1, F2 are connected in series. Namely, the output sound signal MVD1 of the delay circuit 27 in the front-stage comb filter circuit F1 is fed back to the adder 26 and given to the rear-stage comb filter circuit F2, and at the same time the signal MVD1 is also given to a multiplier 48. The multiplier 48 multiplies the output sound signal MVD1 of the delay circuit 27 by a certain mixing coefficient K3 that is supplied, for example, from the parameter generating circuit 19, and then it outputs the multiplication result to an adder 49. In addition, the output of the delay circuit 33 in the rear-stage comb filter circuit F2 is fed back to the adder 32 and is also given to a multiplier 50. The multiplier 50 multiplies the output the delay circuit 33 by a certain mixing coefficient K4 that is supplied, for example, from the parameter generating circuit 19, and then it outputs the multiplication result to the adder 49. Then, the adder 49 parallel adds up (i.e. mixes) the outputs of the comb filter circuits F1, F2 which have been multiplied by the mixing coefficients K3, K4 respectively and outputs the addition result to the low-pass filter 34.

The primary reason why the comb filter circuits F1, F2 are connected in parallel so that the respective outputs of the circuits F1, F2 are parallel added up, is that such an arrangement causes a part of sound generated by the comb filter circuit F1 to leak into the other comb filter circuit F2 in such a manner that there is created a particular resonance effect such as a resonated string effect in a stringed instrument. The second reason is that the arrangement causes tone generation to start as quickly as possible with only one stage delay time (D1 in this case), because process by only one comb filter circuit is often sufficient for a tone that may have relatively gentle resonance frequency peaks. It should be appreciated that with this arrangement, it is not possible to achieve desired steep resonance frequency peaks from the very beginning of tone generation although the tone generation can be started quickly: it is possible to achieve desired steep resonance frequency peaks only after processes by the two filter circuits F1, F2 have been completed. In contrast, with the pitch forming circuit 20 of FIG. 6, it is guaranteed to achieve desired steep resonance frequency peaks from the very beginning of tone generation, but quick tone generation is prevented due to two stage delay times (i.e. D1t and D2t). Further, the third reason is to permit such a control by which the respective output signals of the comb filter circuits F1, F2 are caused by delay time setting data D1 and D2 to have pitches which are different from each other by one octave.

Figure 10:
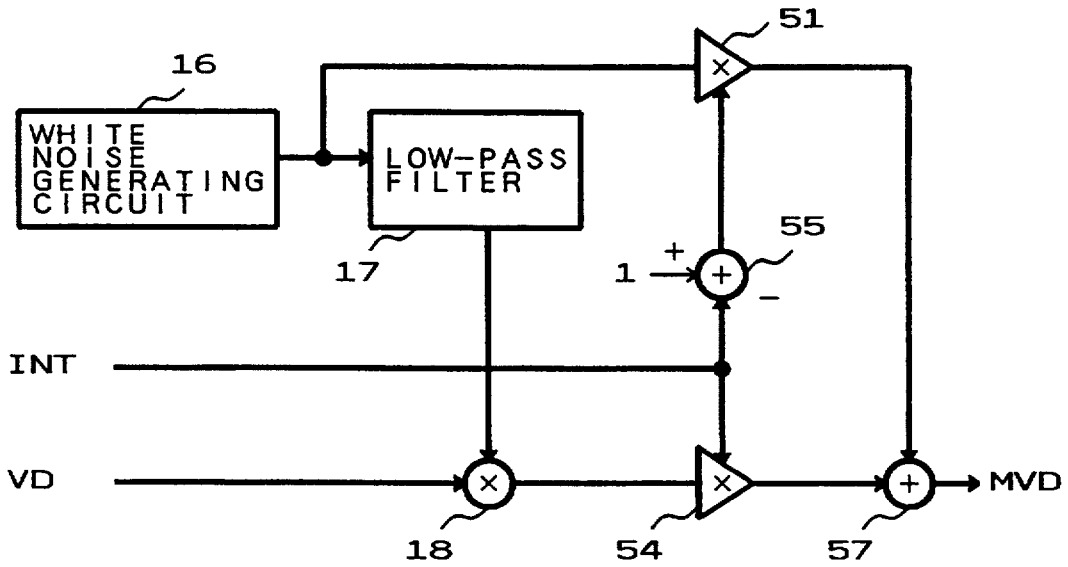
FIG. 10 is a block diagram showing a modification of a sound processing section employed in the tone signal generating circuit of FIG. 5 or FIG. 8.

Moreover, FIG. 10 shows a modification of the sound processing section. This modified sound processing section 15*a* is constructed so that, when no external sound is input through the microphone 9, it directly outputs the white noise signal WN generated by the white noise generator 16. That is to say, the white noise signal WN generated by the white noise generator 16 is given to a multiplier 51, in addition to being applied to the low-pass filter 17 for elimination of high frequency components. On the other hand, the input sound signal VD is amplitude-modulated in the multiplier 18 by the low-pass noise signal LN and then given to a multiplier 54. In addition, the sound signal intensity data INT is given to the multiplier 54 and subtracter 55 without being given to the low-pass filter 17. The multiplier 54 multiples the amplitude-modulated input sound signal VD by the sound signal intensity data INT and then outputs the multiplication result to an adder 57. Also, the subtracter 55 performs a subtraction "1 minus (−) value of sound intensity data INT" and then outputs the subtraction result to the multiplier 51. Further, the multiplier 51 multiplies the white noise WN generated by the white noise generator 16, by the value of the subtract ion result, and then it outputs the multiplication result to the multiplier 57. In this way, the multiplier 57 adds up the outputs of the multipliers 51, 54 and then outputs the addition result as the sound signal MVD. With such an arrangement, when no external sound is input through the microphone 9, the value of the sound intensity data INT results in "0" and hence the output of the multiplier 54 also results in "0", with the result that only the white noise WN is output as the sound signal MVD.

According to this invention, what is modulated by noise is not restricted to a signal input through a microphone but it may be any other signals that are produced by other systems and input via an external signal input connector such as a MIDI (Musical Instrument Digital Interface). Further, the noise modulation may be other than amplitude-modulation, such as frequency -modulation (FM).

Although examples have been described in which plural filters are controlled substantially uniformly in response to the same pitch of input sound signal, the plural filters may be controlled in response different pitches. To this end, it is sufficient that different time setting data D1 and D2 be supplied directly from, for example, the delay time table 43 of FIG. 7 to the filters.

Moreover, in each filter circuit, outputs from looped circuit portions (such as the looped circuit portion denoted by 26, 27, 29, 30, 31 ) may be taken out at any locations other than the rear end of the delay circuit, such as at a location immediately after the adder or in the middle of the delay circuit. In the case where the outputs are taken out at a location immediately after the adder, start of tone generation can be further quickened if the initial effectiveness of filters is not taken into account.

Further, although in the above-described embodiment detune and tone color are controlled in response to an initial touch, they may of course be controlled by other factors.

As may be apparent from the foregoing, the present invention is not directed to generating a tone signal merely on the basis of the processing of fixed noise signal. But, according to the invention, any desired or irregular sound signal is input from the outside for modulation with noise, and a tone signal is generated on the basis of such modulation. Because of this arrangement, the invention achieves a superior advantage that tone color of a tone to be generated can be controlled in an extensive diversified manner with increased flexibility, without relying on complex and large-scaled circuitry.

What is claimed is:

1. A tone signal generating device comprising:
a noise signal generating source for providing a noise signal;
signal inputting means for inputting an input signal;
modulating means for modulating one of the noise signal and the input signal from said signal inputting means with the other of the signals, to provide a modulated signal;
control information providing means for providing control information to determine pitch of a tone to be generated;
frequency content controlling means for controlling, in accordance with said control information, the frequency content of the modulated signal to produce a tone signal having a specific tone pitch corresponding to said control information.

2. A tone signal generating device as defined in claim 1, wherein said frequency content controlling means controls the frequency content of the modulated signal in accordance with the control information to extract from the modulated signal frequency components corresponding to a specific tone pitch.

3. A tone signal generating device as defined in claim 1 in which said frequency content controlling means includes a comb filter.

4. A tone signal generating device as defined in claim 1, wherein said frequency content controlling means includes a plurality of comb filters and provides different parameters for the respective comb filters in accordance with said control information.

5. A tone signal generating device as defined in claim 4, in which said frequency content controlling means provides different parameters for the respective comb filters at a part of a tone generation period.

6. A tone generating device as defined in claim 1, in which said frequency content controlling means includes a plurality of closed loops which are cascaded with each other, each of said closed loops has delay means for delaying a signal input thereto by a delay time corresponding to the pitch of the tone to be generated, and filter means for filtering a signal input thereto.

7. A tone signal generating device as defined in claims 1, further comprising:
means for detecting an intensity of the input signal;
modifying means for modifying the frequency content of said noise signal based upon said intensity; and wherein
said modulating means comprises means for modulating the input signal with the noise signal whose frequency content has been modified by said modifying means.

8. A tone signal generating device as defined in claim 1, in which said modulating means comprises means for detecting an envelope of the sound signal input from said sound signal inputting means, filter means for variably controlling the frequency content of the signal generated from said noise signal generating source with the detected envelope, and means for modulating the input signal from said signal inputting means with the noise signal whose frequency content has been controlled by said filter means.

9. A tone signal generating device as defined in claim 1, in which said modulating means modulates the input signal in accordance with an amplitude-modulation technique.

10. A tone signal generating device as defined in claim 1, in which said modulating means modulates the input signal in accordance with a frequency-modulation technique.

11. A tone signal generating device as defined in claim 1, in which said signal inputting means includes microphone means for picking up an audible signal from outside.

12. A tone signal generating device as defined in claim 1, in which said signal inputting means further comprises an external signal inputting connector means for inputting a signal produced from an external musical instrument.

13. A tone signal generating device as defined in claim 1, further comprising means for detecting an intensity of said input signal and wherein:
said modifying means includes variable filter means for variably modifying said frequency content of the noise signal generated by said noise signal generating means in accordance with the intensity detected by said detecting means.

14. A tone signal generating device as defined in claim 1, further comprising a modifying means between said noise signal generating source and said modulating means for modifying the frequency content of said noise signal.

15. An electronic musical instrument comprising:
pitch designating means for designating a pitch of a tone to be generated;
signal generating source for generating a noise signal;
signal inputting means for inputting an input signal from an external source;
modulating means for modulating one of said nowise signal and said input signal with the other of the signals to provide a modulated signal; and
pitch forming means for inputting the modulated signal and extracting from the modulated signal frequency components corresponding to the pitch designated by said pitch designating means, so as to generate as a tone signal a signal containing the extracted frequency components.

16. An electronic musical instrument as defined in claim 15, which further comprises means for controlling a tone color of the tone signal generated by said pitch forming means.

17. An electronic musical instrument as defined in claim 15, in which said pitch forming means includes means for detuning a pitch of the tone signal with respect to the pitch designated by said pitch designating means.

* * * * *